US007076923B2

(12) United States Patent
Seldon

(10) Patent No.: US 7,076,923 B2
(45) Date of Patent: Jul. 18, 2006

(54) SIMULATED EXPOSED ROOF RAFTER END

(76) Inventor: William G. Seldon, 1505 Kilborn Dr., Petoskey, MI (US) 49770

( * ) Notice: Subject to any disclaimer, the term of this patent is extended or adjusted under 35 U.S.C. 154(b) by 303 days.

(21) Appl. No.: 10/064,989

(22) Filed: Sep. 6, 2002

(65) Prior Publication Data

US 2003/0041531 A1 Mar. 6, 2003

Related U.S. Application Data

(60) Provisional application No. 60/357,965, filed on Feb. 19, 2002, provisional application No. 60/334,872, filed on Nov. 15, 2001, provisional application No. 60/317,634, filed on Sep. 6, 2001.

(51) Int. Cl.
*E04B 7/04* (2006.01)

(52) U.S. Cl. ..... 52/93.2; 52/94; 52/96; 52/DIG. 8

(58) Field of Classification Search ..... 52/93.2, 52/94, 95, 96, DIG. 8, 311.1, 12, 233; D25/17; D8/354, 373, 380; 248/48.1, 237
See application file for complete search history.

(56) References Cited

U.S. PATENT DOCUMENTS

| | | | | | |
|---|---|---|---|---|---|
| 797,474 | A | * | 8/1905 | Walker | 52/63 |
| 831,810 | A | * | 9/1906 | Walker | 52/93.2 |
| 899,022 | A | * | 9/1908 | Benson | 52/529 |
| 1,316,968 | A | * | 9/1919 | Neill et al. | 220/648 |
| 1,336,118 | A | * | 4/1920 | Wright | 52/94 |
| 1,499,041 | A | * | 6/1924 | Vick | 52/94 |
| 1,643,934 | A | * | 9/1927 | Flagge | 52/465 |
| 2,111,251 | A | * | 3/1938 | Spilsbury | 52/94 |
| 2,276,804 | A | * | 3/1942 | Taylor et al. | 52/94 |
| 2,402,318 | A | * | 6/1946 | Edwards | 52/94 |
| 2,931,129 | A | * | 4/1960 | Boniface | 446/126 |
| 3,387,872 | A | * | 6/1968 | Lovullo et al. | 52/714 |
| 3,507,079 | A | * | 4/1970 | George | 52/74 |
| D220,944 | S | * | 6/1971 | Thomson | D25/18 |
| 3,740,084 | A | * | 6/1973 | Tellberg | 403/171 |
| 3,836,270 | A | * | 9/1974 | Chambers | 403/218 |
| 4,076,432 | A | * | 2/1978 | Glaser | 403/176 |
| D248,447 | S | * | 7/1978 | Hornung | D8/354 |
| D249,459 | S | * | 9/1978 | Halliwell | D8/354 |
| 4,283,894 | A | * | 8/1981 | Raty | 52/311.1 |
| 4,449,842 | A | * | 5/1984 | Reichman, Jr. | 403/25 |
| 4,461,128 | A | * | 7/1984 | Knoebl | 52/94 |
| 4,866,901 | A | * | 9/1989 | Sanchez | 52/514 |
| 4,885,883 | A | * | 12/1989 | Wright | 52/280 |
| 4,969,250 | A | * | 11/1990 | Hickman et al. | 29/521 |
| 4,974,387 | A | * | 12/1990 | Dufour | 52/639 |
| 5,335,462 | A | | 8/1994 | Park | |
| 5,419,089 | A | | 5/1995 | Hill | |

(Continued)

*Primary Examiner*—Carl D. Friedman
*Assistant Examiner*—Chi Q. Nguyen
(74) *Attorney, Agent, or Firm*—McGarry Bair PC

(57) ABSTRACT

An exposed rafter end is simulated by a frame and complementary sleeve. The frame is attached to a building eave and the sleeve is inserted over the frame. In an alternative embodiment, the sleeve is inserted over an exposed rafter end. In yet another embodiment, the simulated exposed roof rafter end comprises an architectural design at a distal end and a cradle at a proximal end having a shape which is complementary to the profile of a conventional rain gutter to thereby cradle the rain gutter and provide support thereto. The simulated exposed roof rafter end can also comprise a solid member without a cradle for use without a rain gutter system.

9 Claims, 19 Drawing Sheets

U.S. PATENT DOCUMENTS 5,433,048 A 7/1995 Strasser
5,546,726 A * 8/1996 Stalzer ..... 52/702
5,579,617 A 12/1996 Schiedegger et al.
5,660,005 A * 8/1997 Tacoma ..... 52/93.2
5,797,220 A * 8/1998 Zaccagni ..... 52/11
5,850,717 A 12/1998 Schiedegger et al.
D409,078 S * 5/1999 Bolt ..... D8/354
5,946,864 A * 9/1999 Simpson ..... 52/94
6,047,513 A * 4/2000 Gibson ..... 52/646
6,088,992 A * 7/2000 Nunley ..... 52/783.19
D428,798 S * 8/2000 Marino et al. ..... D8/354
6,138,418 A * 10/2000 Dyer et al. ..... 52/94
D437,282 S * 2/2001 Joll ..... D12/223
6,212,829 B1 * 4/2001 Webb et al. ..... 52/96
6,782,666 B1 * 8/2004 Condon et al. ..... 52/93.2
6,829,862 B1 * 12/2004 Skulsky ..... 52/95
6,918,213 B1 * 7/2005 Burkart et al. ..... 52/94

* cited by examiner

SIMULATED EXPOSED ROOF RAFTER END

CROSS REFERENCE TO RELATED APPLICATIONS

This application claims the benefit of U.S. provisional applications Ser. Nos. 60/317,634, filed Sep. 6, 2001, 60/334,872, filed Nov. 15, 2001, and 60/357,965, filed Feb. 19, 2002.

BACKGROUND OF INVENTION

1. Field of the Invention

The invention relates to roofs. In one aspect, the invention relates to a simulated exposed roof rafter end. In another aspect, the invention relates to a simulated exposed roof rafter end with an integral rain gutter support.

2. Description of the Related Art

A pitched roof is typically constructed with a plurality of parallel rafters that support the overlying roof deck and shingles. The rafters extend beyond the building walls to form eaves comprising a soffit attached to the undersides of the rafters and a transversely-extending eaves fascia that encloses the rafter ends within the eaves. However, certain architectural styles call for exposed rafter ends that may extend beyond the eaves or roof line. With such a style, the rafter ends should all extend the same distance beyond the eaves or roof line to establish an architectural appearance of uniformity. Consequently, it is necessary to trim each of the rafter ends by hand, which involves striking a line along the rafter ends parallel to the roof line and cutting each rafter to the line, a time-consuming and costly process. Furthermore, it may be desirable to give the exposed rafters a decorative shape, which, in addition to cutting the rafter ends to length, involves hand cutting the selected design to provide the desired shape. This also is a time-consuming process and can involve the generation of a significant quantity of waste material.

Flat roofs are also constructed with exposed rafter ends, with the same construction requirements and limitations as for the pitched roof described above.

Rain gutters are used to catch precipitation flowing off the roof and direct it to selected locations, generally away from walkways and entryways. Rain gutters are typically installed along the roof line by attaching the rain gutter to the eaves fascia with brackets or other mounting fixtures. However, exposed roof rafter ends extending beyond the fascia or roof line can interfere with or complicate the installation of rain gutters, or can preclude the use of rain gutters altogether.

SUMMARY OF INVENTION

According to the invention, a simulated exposed roof rafter end for mounting to a building having an eave comprising a soffit and a fascia comprises a sleeve portion and a mounting portion, with the mounting portion being adapted for attachment to the building, and the sleeve portion being adapted for slidable attachment to the mounting portion and comprising a distal end having an architectural design. In one embodiment, the mounting portion is a frame. In another embodiment, the mounting portion is a block of wood, which can include a rafter end. The sleeve portion comprises a top wall, a bottom wall, and a pair of spaced-apart side walls for enclosing the mounting portion. In another embodiment, the mounting portion is attached to the soffit, and the sleeve portion comprises a bottom wall and a pair of spaced-apart side walls for enclosing the mounting portion. In yet another embodiment, the simulated exposed roof rafter end further comprises an integral electrical socket and wiring for operable attachment of a light bulb. The simulated exposed roof rafter end further comprises a proximal end having an integral rain gutter support, and a rain gutter supported therein. The rain gutter support comprises a cradle having a profile complementary to the cross-sectional profile of the rain gutter. In another embodiment, the rain gutter support further comprises a top strap extending over the rain gutter. In yet another embodiment, the simulated exposed roof rafter end further comprises a web portion terminating in a peripheral flange. In a further embodiment, the simulated exposed roof rafter end further comprises at least one retaining flange retaining the rain gutter in the cradle. The at least one retaining flange comprises a retaining flange extending laterally from the distal end and a retaining lip depending from the retaining flange, and/or a retaining flange extending laterally from the proximal end and a retaining lip depending from the retaining flange. In yet another embodiment, the rain gutter comprises a flexible, sheet-like rain gutter. According to another embodiment of the invention, a simulated exposed roof rafter end is combined with a roof eave comprising a fascia and a soffit, and comprises a sleeve portion and a mounting portion, with the mounting portion attached to a building, and the sleeve portion slidably attached to the mounting portion and comprising a distal end having an architectural design. According to yet another embodiment of the invention, a simulated exposed roof rafter end for mounting to a building comprises a proximal end having mounting portion, the mounting portion being adapted for attachment to a building, and a distal end having an integral rain gutter support, a rain gutter supported therein, and an architectural design.

DETAILED DESCRIPTION

The invention simulates exposed rafter ends while avoiding the time-consuming construction required for this style of roof. In one embodiment, simulated roof rafter ends are added to an eaves fascia of a roof having unexposed rafters to simulate exposed rafter ends. In another embodiment, a rafter sleeve is added to existing exposed rafters or nailers. In yet another embodiment, the simulated exposed roof rafter ends can be adapted to integrally support a rain gutter, thereby combining the architectural flourish of an exposed roof rafter end with the benefits of a roof rain gutter system.

Figure 3:
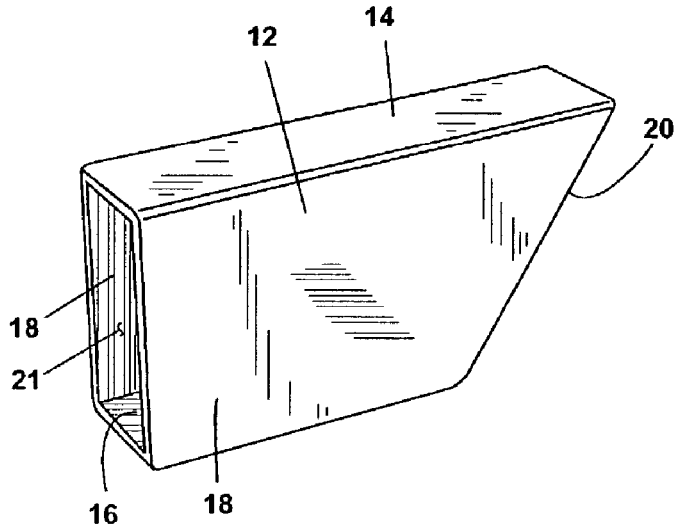
FIG. 3 is a perspective view of the sleeve shown in FIG. 1.
Figure 4:
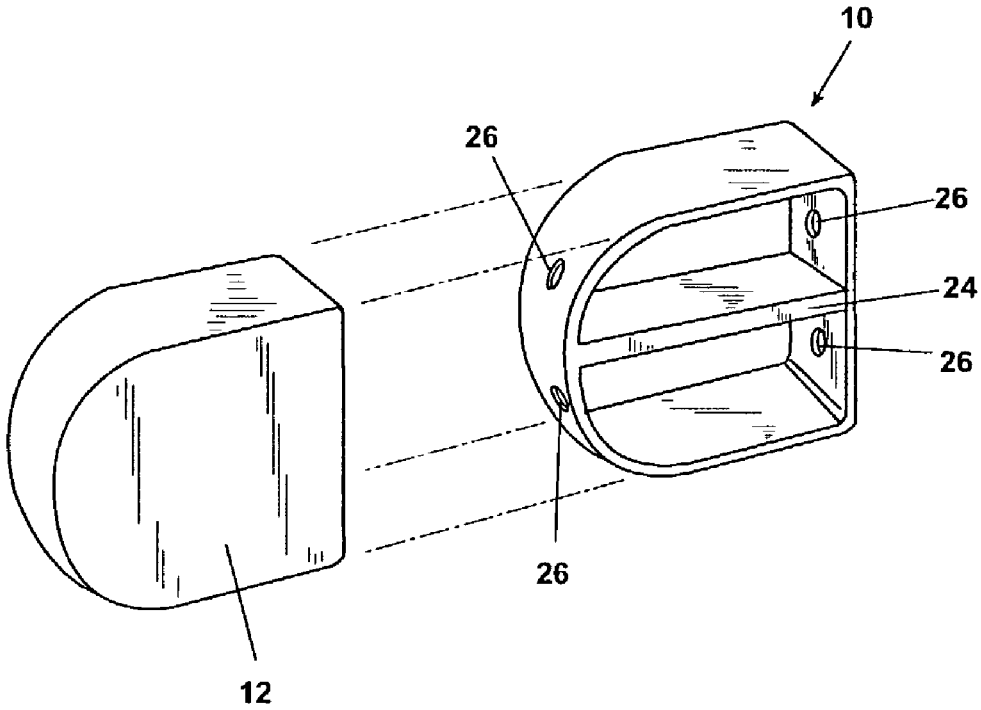
FIG. 4 is an exploded perspective view of a second embodiment of the invention.

Referring now to FIGS. 1–4, in a first embodiment of the invention a simulated roof rafter end comprises a frame 10 that is attached to an eaves fascia, and a sleeve 12 that is adapted to be slidably received over the frame 10, as hereinafter described. The sleeve 12 comprises a top wall 14, a bottom wall 16, side walls 18, and an end wall 20, rigidly assembled into a selected shape, e.g. square, trapezoidal, or semicircular, and defining an enclosed receptacle 21 (FIGS. 3 and 4). The corresponding frame 10 has a shape complementary to that of the sleeve 12, and can comprise an open frame or a solid block. The frame 10 and the sleeve 12 are adapted so that the frame 10 is slidably received in the receptacle 21 when the frame 10 and the sleeve 12 are assembled into the simulated rafter end. If the appearance of a square cut rafter end is desired, the frame 10 and the sleeve 12 will have a rectilinear shape. If the appearance of a plumb cut rafter end is desired, the frame 10 and the sleeve 12 will take the shape of a parallelogram.

The open frame 10 comprises an outer box 22 with cross-braces 24 to provide strength and rigidity. The cross-braces 24 can either comprise a separate assembly, which is inserted into the outer frame 10 during the attachment of the frame 10 to an eaves fascia, or the outer box 22 and cross-braces 24 can be fabricated as a single piece. Alternately, the frame 10 can comprise a solid block, thus eliminating the cross-braces 24. Suitable mounting apertures 26 are provided for attaching the frame 10 to the eaves fascia and for attaching the sleeve 12 to the frame 10. In one embodiment, the cross-braces 24 comprise a separate assembly to be installed after the outer box 22 has been attached to an eaves fascia, and apertures are thus not provided through the cross-braces 24. In another embodiment, the cross-braces 24 and outer box 22 are fabricated as a single piece, and apertures 26 are provided through the cross-braces 24 to enable a mounting screw to be inserted through the outer box 22 and the cross-braces 24 and into the eaves fascia 28. In yet another embodiment in which the frame 10 comprises a solid block, suitable apertures are provided through the block to enable the block to be attached to the eaves fascia. 28. Preferably, at least one conventional wood screw (not shown) is used to attach the frame 10 to the eaves fascia 28, and at least one conventional wood or machine screw (not shown) is used to secure the sleeve 12 to the frame 10. The frame 10 and the sleeve 12 comprise a material providing suitable strength and durability, such as a high-strength plastic. The sleeve 12 can also be colored to coordinate with the color scheme of the building.

Figure 1:
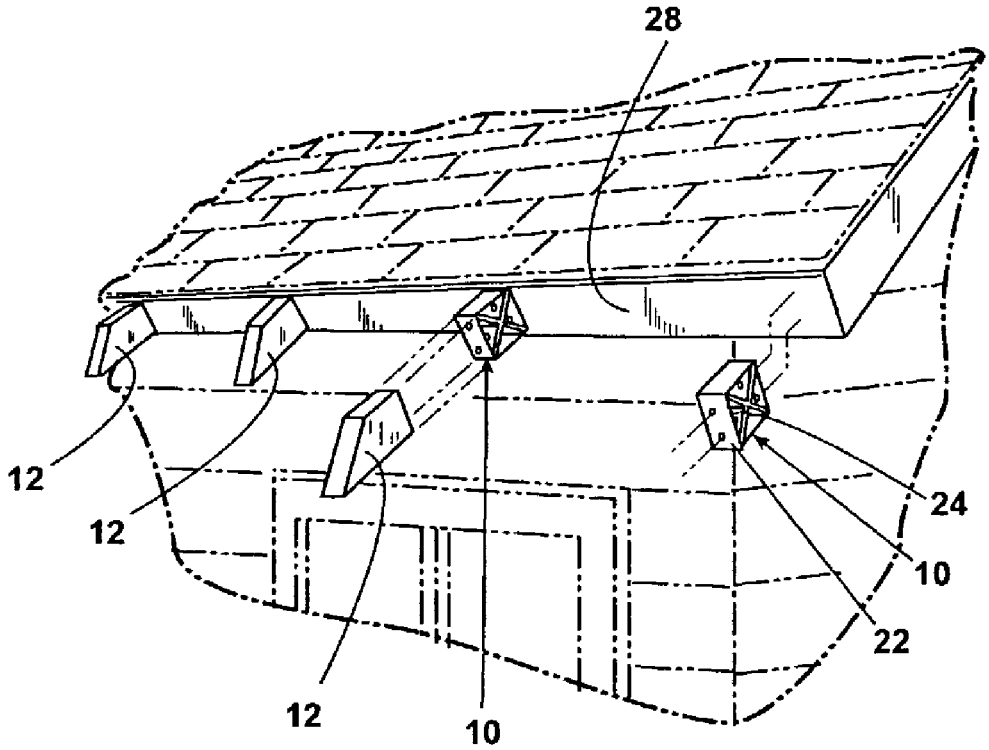
FIG. 1 is a perspective view of a portion of a roof showing a simulated roof rafter end comprising a sleeve and a frame according to one embodiment of the invention.
Figure 2:
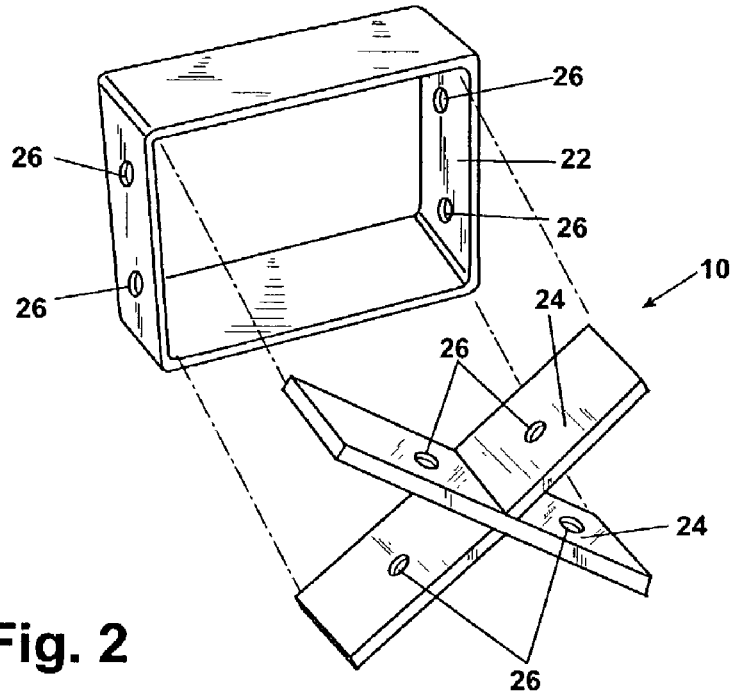
FIG. 2 is an exploded view of the frame shown in FIG. 1.

Referring to FIG. 1, the frame 10 is first attached to an eaves fascia 28. Where the frame 10 comprises an outer box 22 and cross-braces 24, the outer box 22 is attached to the fascia, and the cross-braces 24 are then inserted into the outer box 22. Otherwise, the frame 10 is attached to the eaves fascia as a single piece. The sleeve 12 is then inserted over and secured to the frame 10. The sleeves 12 can be readily aligned by sliding the sleeves 12 slightly inwardly or outwardly on the frames 10.

Figure 5:
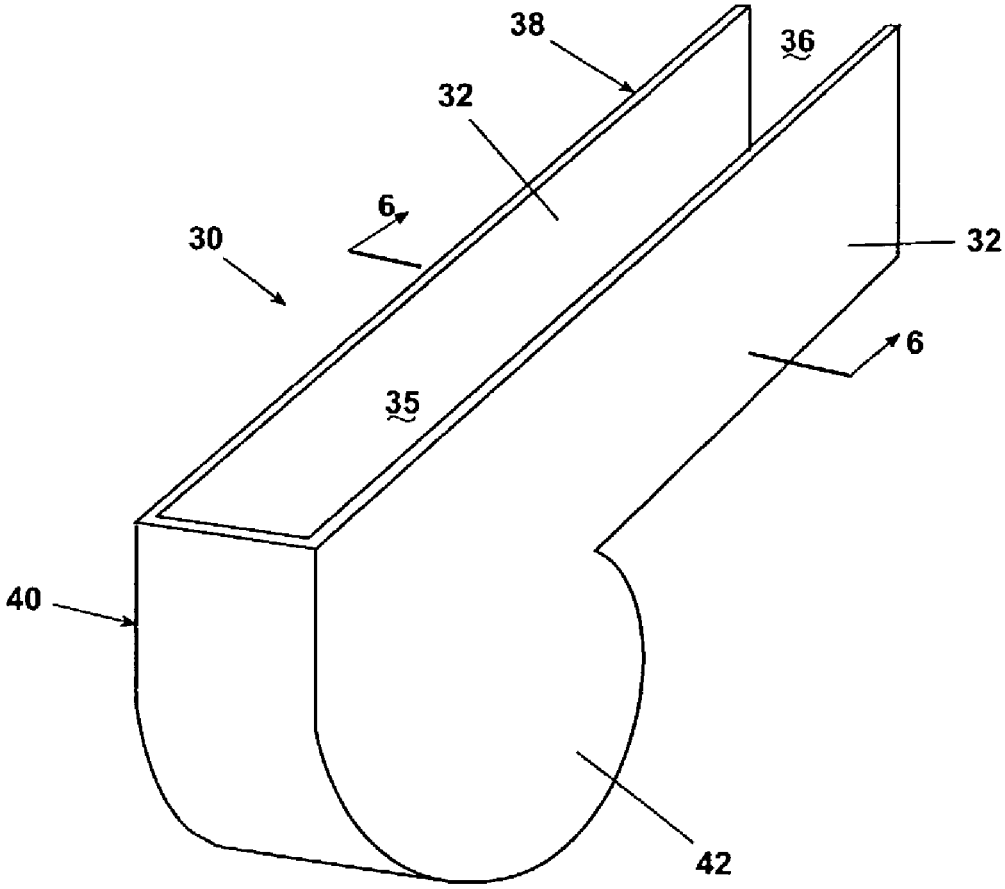
FIG. 5 is a perspective view of a third embodiment of a sleeve for use over an exposed roof rafter end.
Figure 6:
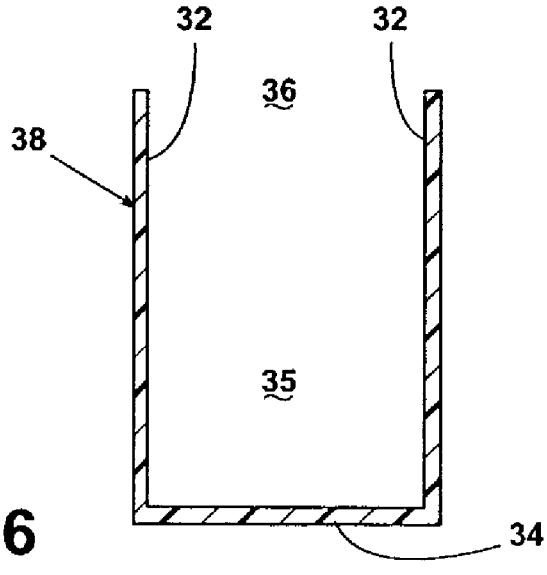
FIG. 6 is a cross-sectional view of the sleeve of FIG. 5 taken along line 6—6 of FIG. 5.
Figure 7:
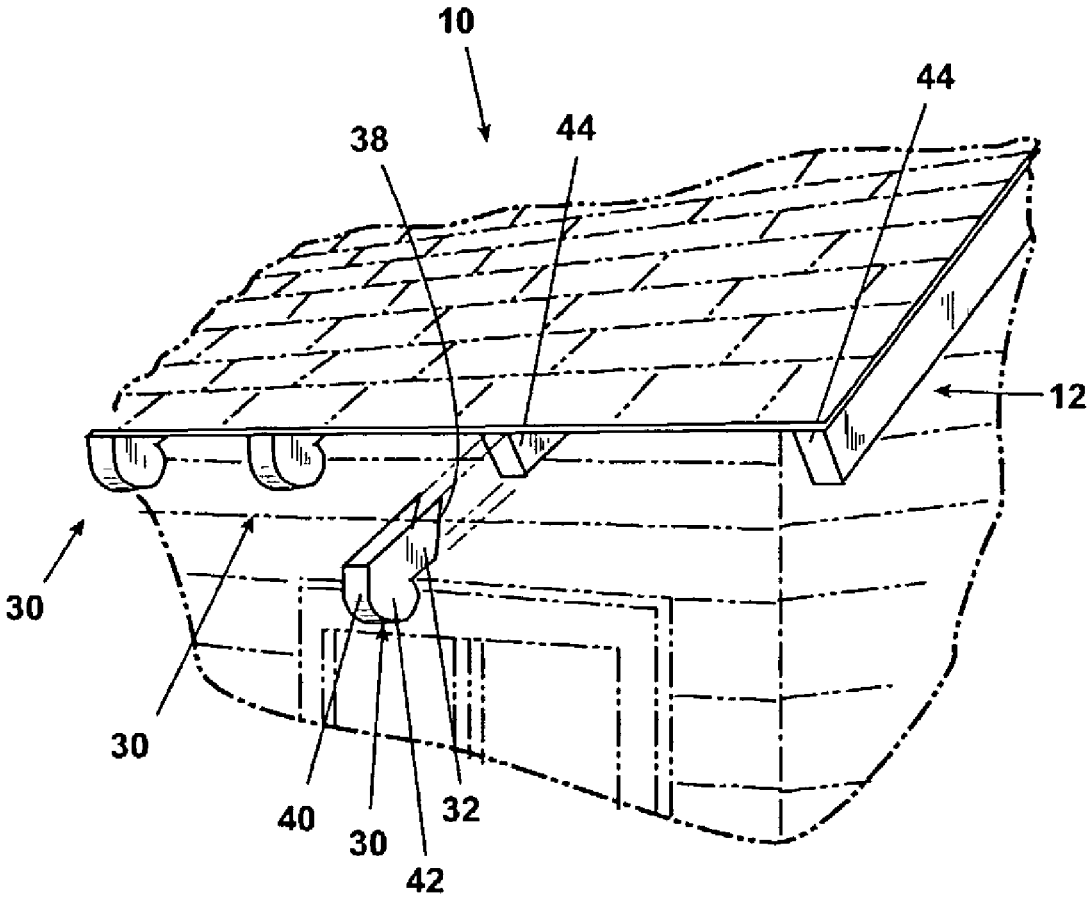
FIG. 7 is a perspective view of a portion of a roof showing the attachment of the sleeve of FIG. 5 to an exposed roof rafter end.

A third embodiment utilizes existing rafter ends or nailers to readily provide an exposed rafter end while avoiding time-consuming and costly handwork. Referring to FIGS. 5–6, a rafter sleeve 30 comprises a generally elongated member with a channel-shaped cross section comprising a pair of side walls 32, a bottom wall 34, and having an open top 36, defining an enclosed space 35 adapted to slidably receive a rafter or nailer, as hereinafter described. The sleeve comprises an open proximal end 38 and a closed distal end 40. The distal end 40 can comprise an architectural enhancement 42, such as a rounded projection, as shown in FIG. 5. The sleeve 30 is attached to the rafter/nailer with suitable fasteners, such as wood screws (not shown). The proximal end 38 is open so that the sleeve 30 can be slipped over the rafter end/nailer 44 in abutting relationship with a wall of a building. In the embodiment comprising the channel-shaped cross section, the sleeve 30 is slipped over the exposed rafter/nailer 44 from the underside so that the walls 32, 34 are in slidable communication with the rafter end/nailer 44 and cover the sides and bottom of the rafter/nailer (FIG. 7).

The sleeve 30 is secured to the rafter/nailer 44 with at least one suitable fastener, such as a screw. In this manner, a plurality of sleeves 30 can be quickly aligned and attached to the exposed rafters/nailers.

Figure 8:
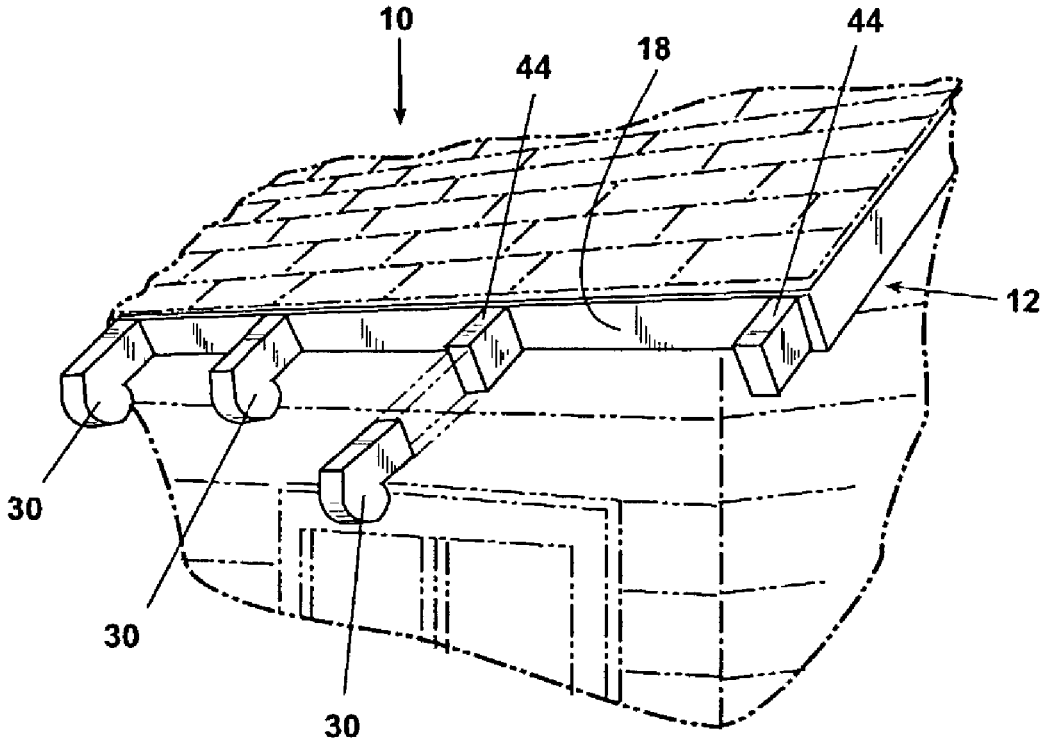
FIG. 8 is a perspective view of a portion of a roof showing the attachment of a fourth embodiment of the sleeve to an exposed roof rafter end.

In a fourth embodiment, the sleeve 30 has a closed cross section, similar to the sleeve 22 shown in FIG. 3, so that the sleeve can be inserted over a rafter end or nailer 44 that is exposed on the top, sides, and bottom (FIG. 8). A plurality of sleeves 30 can be quickly inserted over the rafter ends/nailers 44, aligned, and attached using at least one conventional fastener, such as a screw.

The simulated exposed roof rafter end can comprise a solid member, thereby eliminating the frame 10. It will be apparent that, with this embodiment, the simulated exposed roof rafter end can be attached to a fascia board or the end of an existing roof rafter, but cannot be received over an exposed roof rafter end as can the sleeve described above. This embodiment of the simulated exposed roof rafter end is attached to the fascia board or the end of an existing roof rafter by "toenailing" conventional fasteners, such as screws or nails, through the simulated exposed roof rafter end into the fascia board or existing roof rafter.

The sleeve 30 can be fabricated in a variety of shapes to provide differing architectural styles, can comprise any material providing suitable strength and durability, such as a high-strength plastic, and can be colored to coordinate with the color scheme of the structure. Furthermore, the sleeves 30 can provide protection of the wood rafter ends from the elements, and can be installed over old, damaged wood rafter ends to provide a new appearance, added strength, and protection against further deterioration, while avoiding difficult and costly repairs. Finally, fabrication of the sleeves 12, 30 can be closely controlled to ensure a uniformity of appearance that would be difficult to achieve with hand-cutting design shapes into wood rafter ends.

Figure 9:
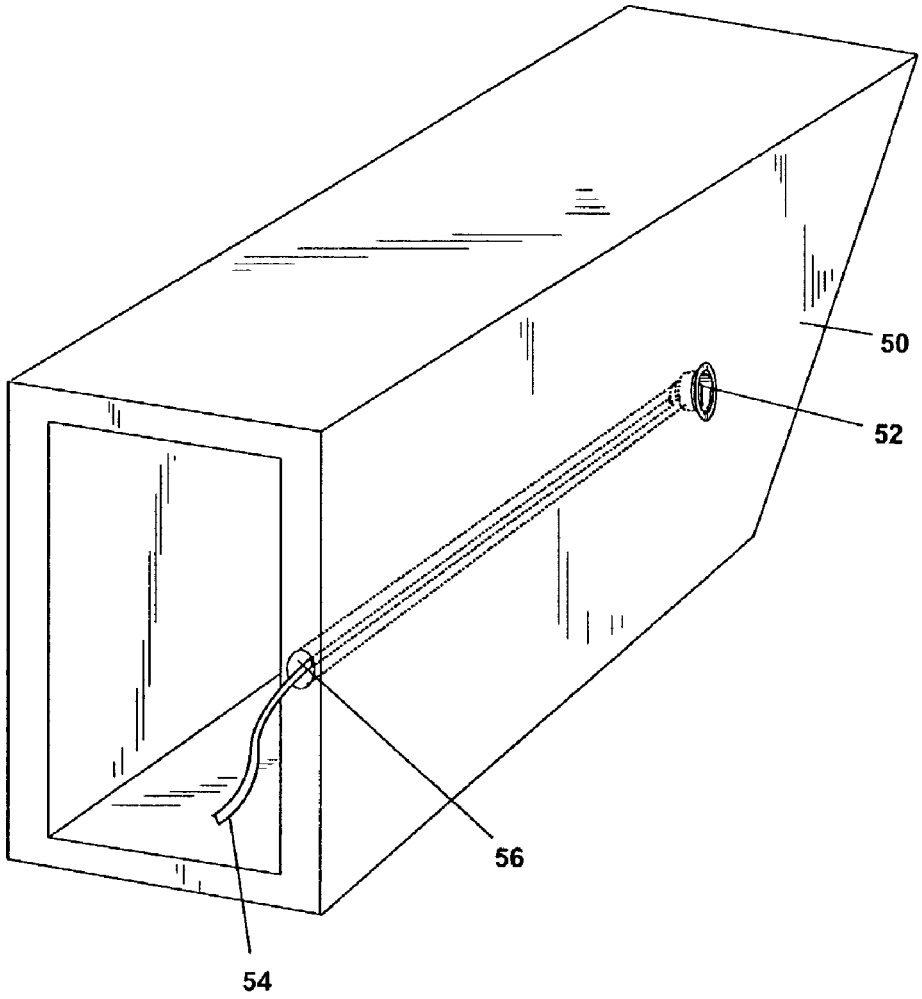
FIG. 9 is a perspective view of a fifth embodiment of the sleeve of FIG. 3 comprising a light socket and wiring for providing decorative lighting along a roofline.
Figure 10:
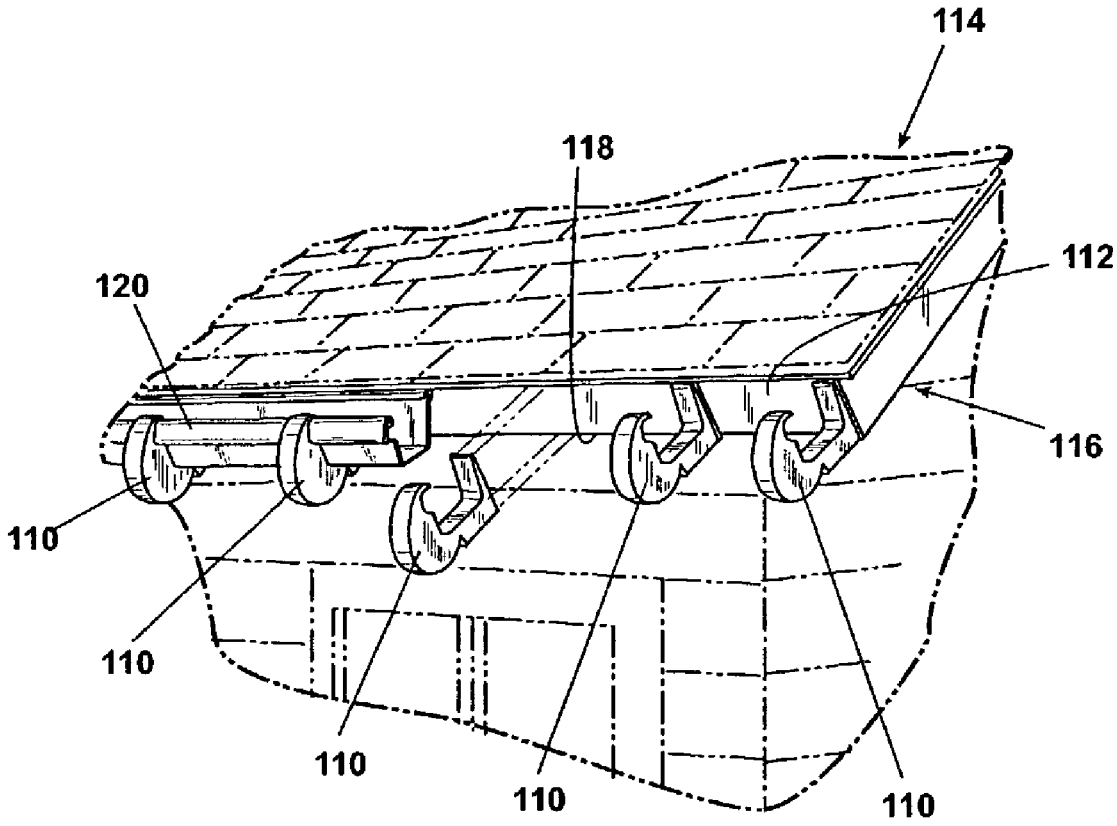
FIG. 10 is a perspective view of a portion of a roof showing a sixth embodiment of the invention comprising a simulated exposed roof rafter end with integral rain gutter support and an attached rain gutter.

In a fifth embodiment, the sleeve can be provided with at least one light socket and wiring to provide decorative lighting, such as Christmas lights, along a roofline. As shown in FIG. 9, a sleeve 50 is provided with a light socket 52 adapted to receive a conventional decorative light (not shown), such as an outdoor Christmas light. In the preferred embodiment, the socket 52 is molded into the sleeve 50. The socket 52 is shown in FIG. 10 molded into one side of the sleeve 50, although it will understood that the socket 52 can be provided in any surface of the sleeve 50 or in a plurality of surfaces to accommodate a plurality of lights. The socket 52 is provided with suitable electrical contacts (not shown) for the decorative light bulb. Electrical wiring 54 is connected to the electrical contacts in the socket 52 and extends to the proximal end of the sleeve 50 adjacent the eaves fascia, such as by molding the wiring into the sleeve 50. Alternatively, the sleeve 50 can be provided with a suitable channel 56 through the sleeve wall for inserting the wiring after the sleeve 50 has been fabricated. A suitable length of wiring extends from the proximal end of the sleeve 50 so that the wiring 54 from each sleeve 50 can be connected and preferably enclosed within a conventional electrical wiring conduit that extends along the eaves fascia parallel to the roofline, to be connected to a conventional electric power supply.

The referenced figures illustrate the simulated exposed rafter ends added to a structure with a pitched roof. It will be understood by one of ordinary skill in the art that the simulated exposed rafter ends disclosed herein can be utilized in a structure with a flat roof.

FIGS. 10–20 show several alternative embodiments of a simulated exposed roof rafter end comprising an integral rain gutter support which is adapted for mounting to an eave fascia comprising either square cut or plumb cut rafters, directly to the rafters themselves, or to a mounting frame. Referring specifically to FIG. 10, a simulated exposed roof rafter end with integral rain gutter support 110 is attached to a fascia board 112 of a roof 114. The roof 114 has an eave 116 enclosing roof rafters (not shown) comprising the fascia board 112 and a soffit 118. The simulated exposed roof rafter ends 110 support a conventional rain gutter 120 to catch and direct the removal of precipitation flowing from the roof 114.

Figure 11:
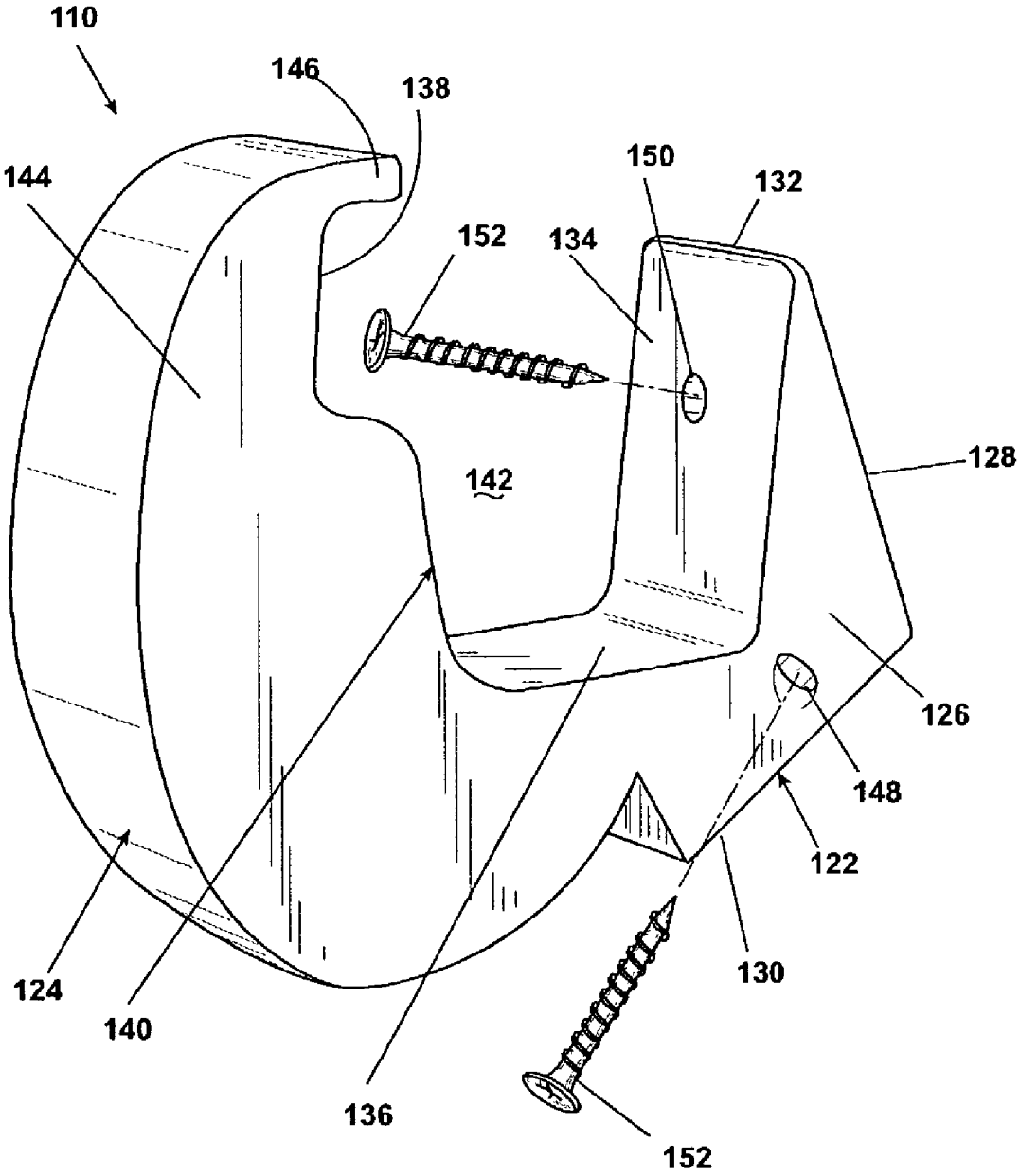
FIG. 11 is a perspective view of the simulated exposed roof rafter end with integral rain gutter support shown in FIG. 10 comprising a gutter cradle having a front gutter retaining flange.

Referring to FIG. 11, a sixth embodiment of the simulated exposed roof rafter end with integral rain gutter support 110 comprises a generally irregularly-shaped solid member comprising a mounting portion at a proximal end 122 and an architectural design section at a distal end 124. The proximal end 122 comprises a pair of spaced-apart, generally parallel side surfaces 126, a back surface 128 orthogonal thereto, and a bottom surface 130 orthogonal to the side surfaces 126 and the back surface 128. The side surfaces 126, back surface 128, and bottom surface 130 define a generally rectilinear form.

The distal end 124 comprises a pair of spaced-apart, generally parallel side surfaces 144, each of which is coplanar with one of the side surfaces 126. As shown in FIG. 11, the profile of the distal end 124 can take the form of a circular arc. Alternatively, the distal end 124 can be rectilinear or spherical, or can take any other preselected shape.

The simulated exposed roof rafter end 110 also has a rain gutter cradle 142 adapted to slidably receive the rain gutter 120. In the preferred embodiment, the rain gutter cradle 142 comprises a cradle inner surface 134, a cradle floor 136, and a cradle outer surface 138, defining a cradle profile 140. The cradle profile 140 is complementary to the exterior profile in cross section of the rain gutter 120. The cradle outer surface 138 defines a compound curve. In the preferred embodiment, which is adapted for a fascia attached to square cut rafters, the back surface 128 is inclined somewhat relative to the cradle inner surface 134 so that the rain gutter 120 is positioned relative to the roof line to catch precipitation flowing from the roof 114. If the rafters are plumb cut, the cradle inner surface 134 and the back surface 128 will be generally parallel, as shown, for example, in FIGS. 17 and 18. In either case, the inclination of the back surface 128 relative to the cradle inner surface 134 is such that the rain gutter 120 is appropriately positioned relative to the roof line for proper removal of precipitation flow from the roof.

The back surface 128 and the cradle inner surface 134 define a top edge 132. The upper portion of the distal end 124 terminates in a retaining flange 146.

Figure 12:
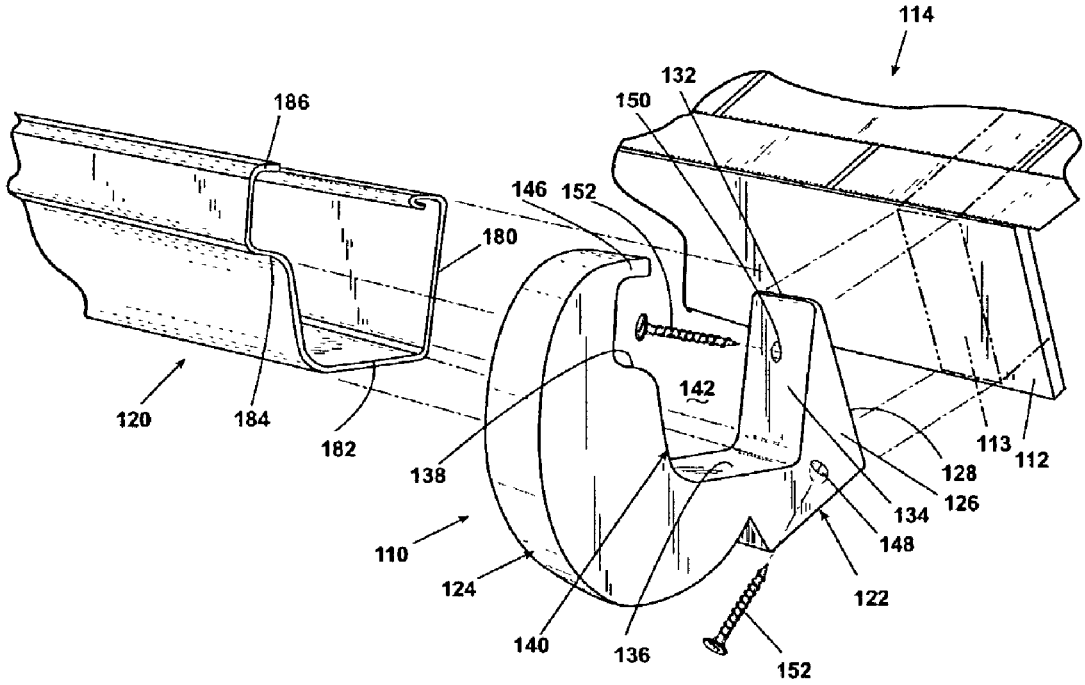
FIG. 12 is an exploded view of a portion of a roof, the simulated exposed roof rafter end of FIG. 11, and a conventional rain gutter showing the attachment of the simulated exposed roof rafter end to the roof and the insertion of the rain gutter therein.

Referring to FIG. 12, a conventional rain gutter 120 comprises a gutter back wall 180, a gutter bottom wall 182, a gutter front wall 184, and a gutter top lip 186. The cradle 142 is adapted so that the cradle inner surface 134 slidably communicates with the gutter back wall 180, the cradle floor 136 slidably communicates with the gutter bottom wall 182, the cradle outer surface 138 slidably communicates with the gutter front wall 184, and the rain retaining flange 146 slidably communicates with the gutter top lip 186. The gutter 120 is thereby securely supported by the simulated exposed roof rafter end with integral rain gutter support 110 without the necessity of securing the rain gutter 120 to the fascia or other support.

The rain gutter 120 of FIG. 12 is shown having a generally rectilinear cross section and a flat bottom wall 182. It will be apparent to one skilled in the art that a curved bottom rain gutter, or rain gutters having other cross-sectional shapes, can also be used with simulated exposed roof rafter ends having a cradle adapted for use with the preselected rain gutter. As well, the simulated exposed roof rafter end with integral rain gutter support 110 can be adapted for a gutter cover or gutter screen, such as by providing slots, fingers, or brackets in or with the simulated exposed roof rafter end to hold the cover/screen at a preferred position relative to the gutter.

The simulated exposed roof rafter end 110 is also provided with mounting apertures for mounting the simulated exposed roof rafter end 110 to the roof fascia 112 or to actual exposed roof rafters. FIGS. 1 and 12 show the simulated exposed roof rafter end 110 with a side mounting aperture 148 and a top mounting aperture 150. The side mounting aperture 148 extends from the side surface 126 to the back surface 128 for insertion of a conventional fastener 152 therethrough and into a mounting surface. Alternatively, a top mounting aperture 150 extends from the cradle inner surface 134 to the back surface 128 for insertion of a conventional fastener 152 therethrough and into a mounting surface. In the preferred embodiment, the conventional fastener 152 comprises a wood screw. It will be apparent to one skilled in the art that a plurality of apertures can be provided, as shown, for example, in FIG. 11 and, alternatively, in FIGS. 16 and 17, through one or more of the side surfaces 126, 192, inner cradle surfaces 134, 202, or bottom surfaces 130, 191, for securing the simulated exposed roof rafter end 110 to the mounting surface. As shown in FIG. 12, the roof rafter end 110 is preferably mounted so that the fasteners 152 are secured through the fascia board 112 and into an actual roof rafter end 113 to ensure a suitably strong connection. The embodiments shown in FIGS. 13–15 and described hereinafter are attached to the fascia/roof rafter end in generally the same manner. Alternatively, the simulated exposed roof rafter end 110 can be provided with a sleeve portion as previously described herein which is mounted to a mounting frame or an exposed roof rafter.

Figure 13:
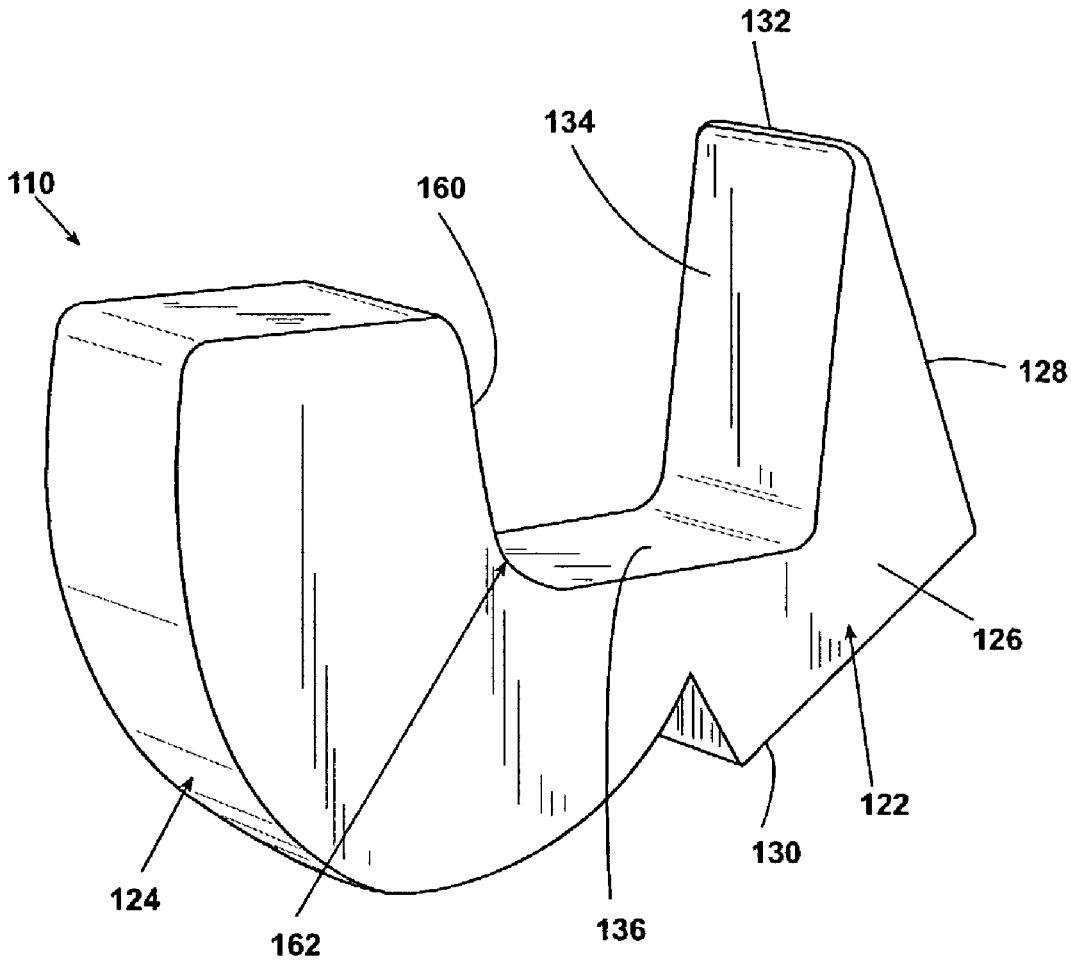
FIG. 13 is a perspective view of a seventh embodiment of the invention comprising a simulated exposed roof rafter end with integral rain gutter support having a modified gutter cradle.

FIG. 13 shows a seventh embodiment of the simulated exposed roof rafter end with integral rain gutter support 110. In this embodiment, the gutter cradle is defined by the cradle inner surface 134, cradle floor 136, and a cradle outer surface 160 defining a shortened cradle profile 162. In this embodiment, the rain gutter 120 is dropped into the rain gutter cradle so that the cradle inner surface 134 slidably communicates with the gutter back wall 180, the cradle floor 136 slidably communicates with the gutter bottom wall 182, and the cradle outer surface 160 slidably communicates with a lower portion of the gutter front wall 184. The gutter 120 is not retained by the rain retaining flange 146. However, the gutter 120 can be secured to the simulated exposed roof rafter end 110 by a suitable conventional fastener such as a nail or a screw.

Figure 14:
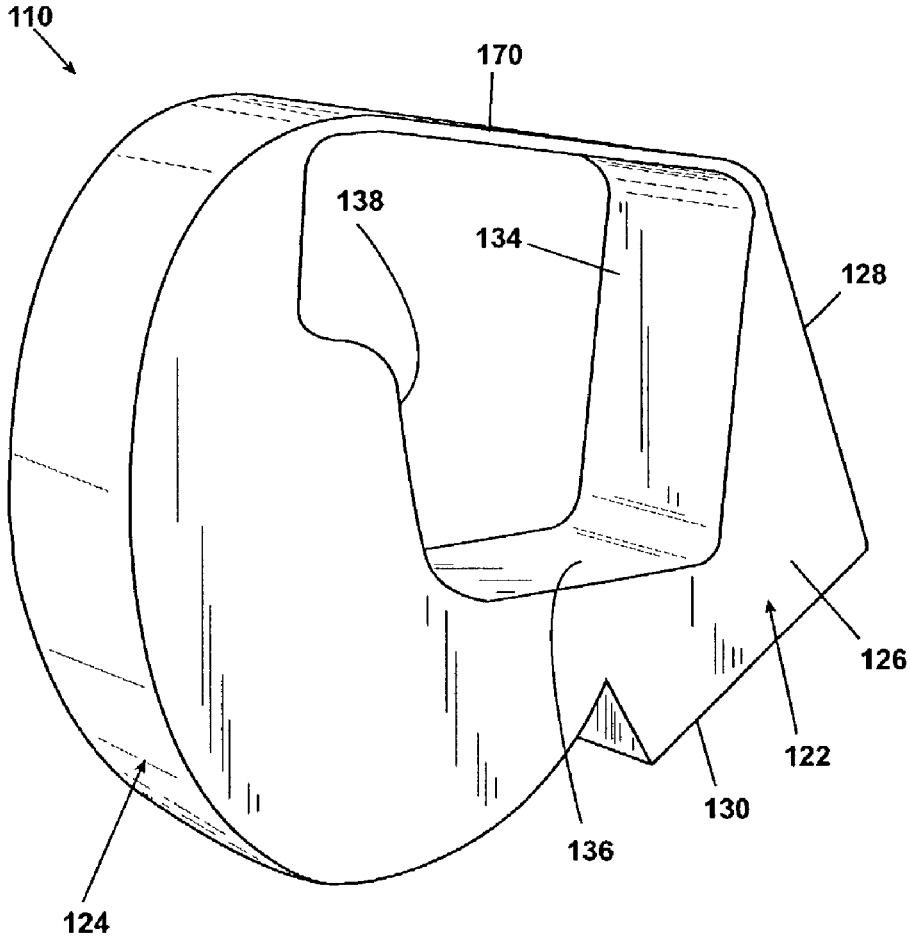
FIG. 14 is a perspective view of an eighth embodiment of the invention comprising a simulated exposed roof rafter end with integral rain gutter support having a gutter cradle with a gutter top strap.

FIG. 14 shows an eighth embodiment of the simulated exposed roof rafter end with integral rain gutter support 110. This embodiment is similar to the embodiment shown in FIG. 11, except that a strap 170 extends from the distal end 124 to the proximal end 122 to completely surround the rain gutter 120. The rain gutter 120 is slidably received within the simulated exposed roof rafter end 110 in generally the same manner as for the sixth embodiment.

Figure 15:
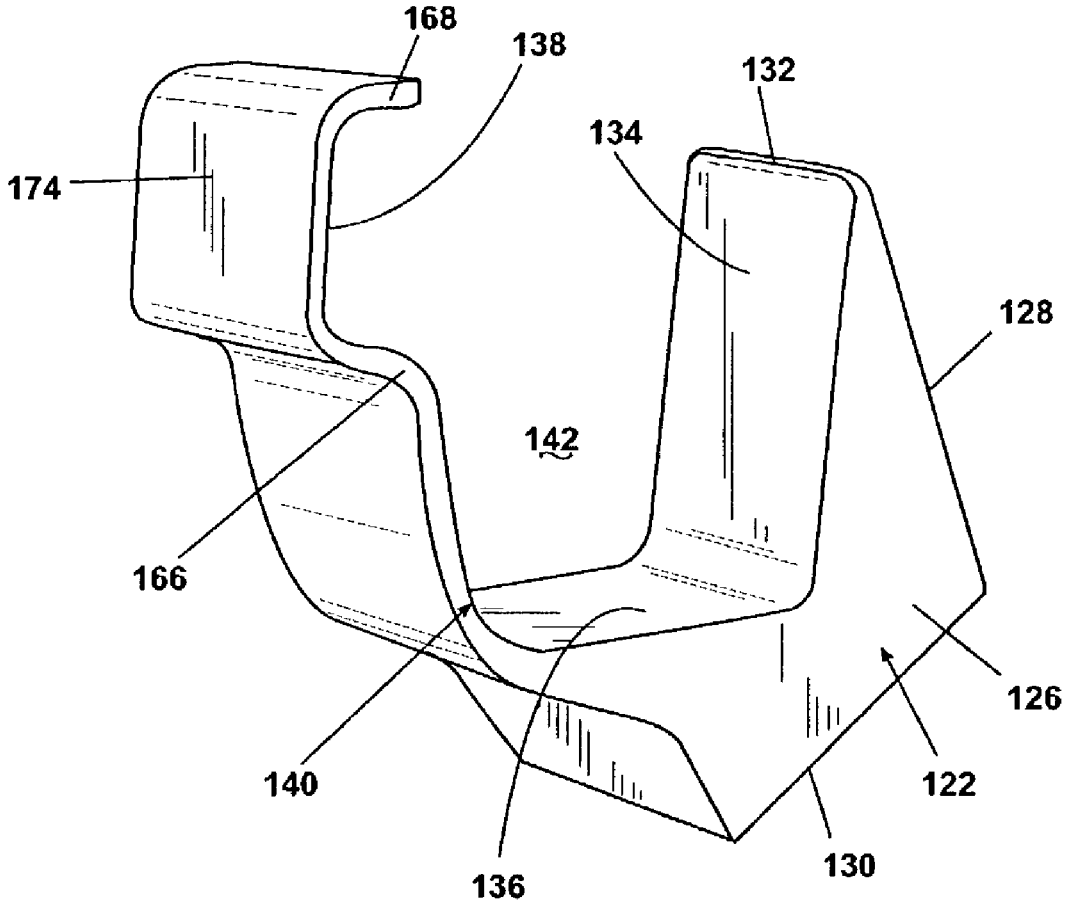
FIG. 15 is a perspective view of a ninth embodiment of the invention comprising a simulated exposed roof rafter end with integral rain gutter support having a modified distal portion.

FIG. 15 shows a ninth embodiment of the simulated exposed roof rafter end with integral rain gutter support 110. This embodiment comprises a simulated exposed roof rafter end 110 having the proximal portion 122 and a distal portion 166 corresponding to the profile of the gutter front wall 184. The distal portion 166 comprises an elongated curved member adapted to extend around the rain gutter 120 and terminate at a profile end 168. The distal portion 166 has an outer surface 174 that is complementary to the inner surface 138 and the gutter front wall 184. The rain gutter 120 is slidably received within the cradle 142 in the same manner as for the sixth embodiment.

Figure 16:
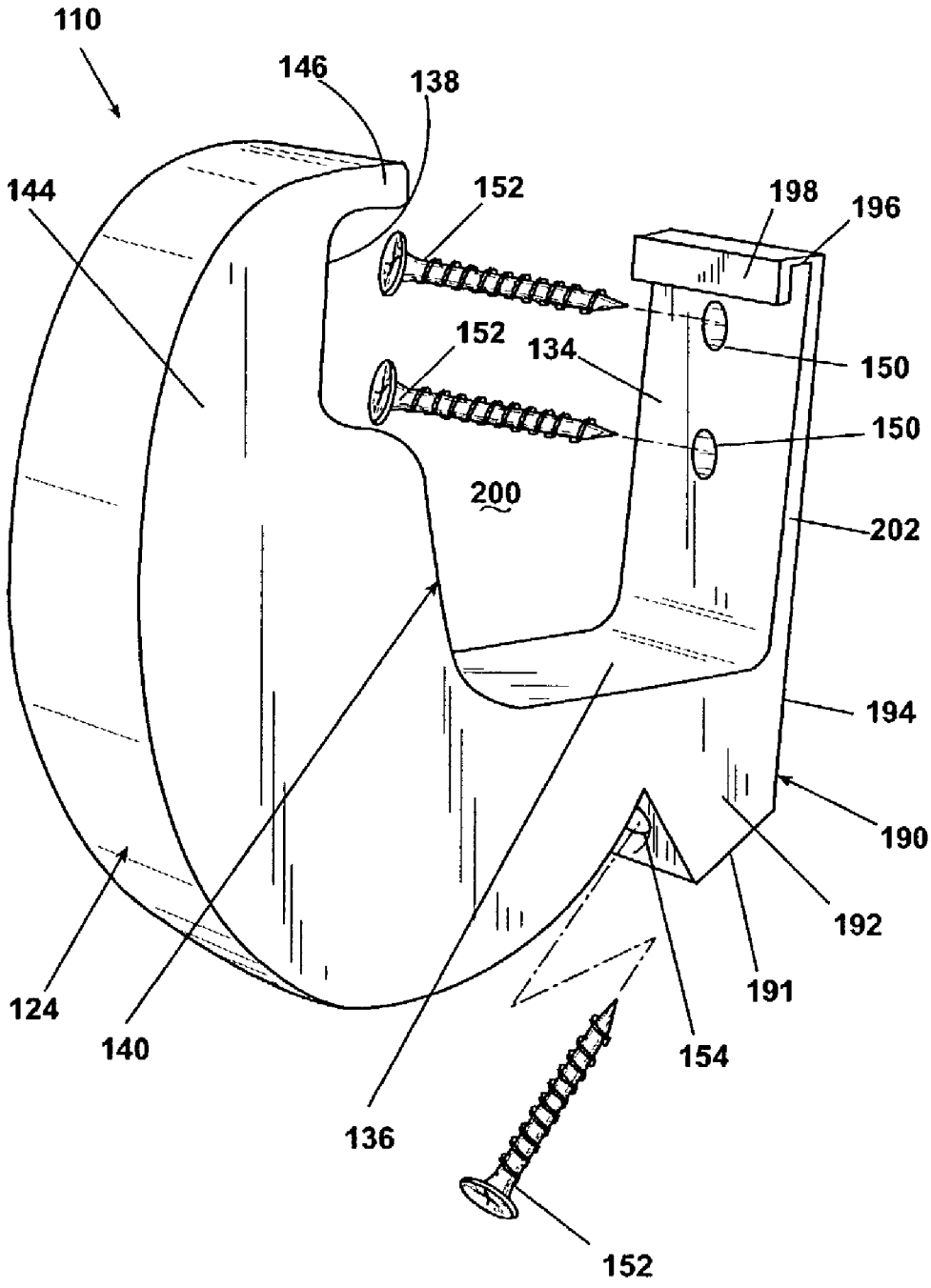
FIG. 16 is a perspective view of a tenth embodiment of the invention comprising a simulated exposed roof rafter end with integral rain gutter support having a rear gutter retaining flange.

FIG. 16 shows a tenth embodiment of the simulated exposed roof rafter end with integral rain gutter support 110. This embodiment is shown adapted for mounting to an eaves fascia having plumb cut rafter ends, although it can be adapted for mounting to an eaves fascia having square cut rafter ends. Thus, the simulated exposed roof rafter end 110 comprises a proximal end 190 having a back surface 194 that is parallel to the cradle inner surface 134. The proximal end 190 comprises a pair of spaced-apart, generally parallel side surfaces 192, the back surface 194 orthogonal thereto, and a bottom surface 191 orthogonal to the side surfaces 192 and the back surface 194. The side surfaces 192, back surface 194, and bottom surface 191 define a generally rectilinear form. The back surface 194 and the cradle inner surface 134 define an upwardly-extending back leg 202. This embodiment comprises a gutter cradle 200 that is complementary to the profile of the rain gutter 120, and a rear retaining flange 196 extending inwardly from the upper end of the back leg 202 orthogonal thereto. The rear retaining flange 196 terminates in a downwardly-extending rear retaining flange lip 198 orthogonal to the rear retaining flange 196. The upper end of the back leg 202, the rear retaining flange 196, and the rear retaining flange lip 198 define a rear gutter wall slot 204.

Figure 18:
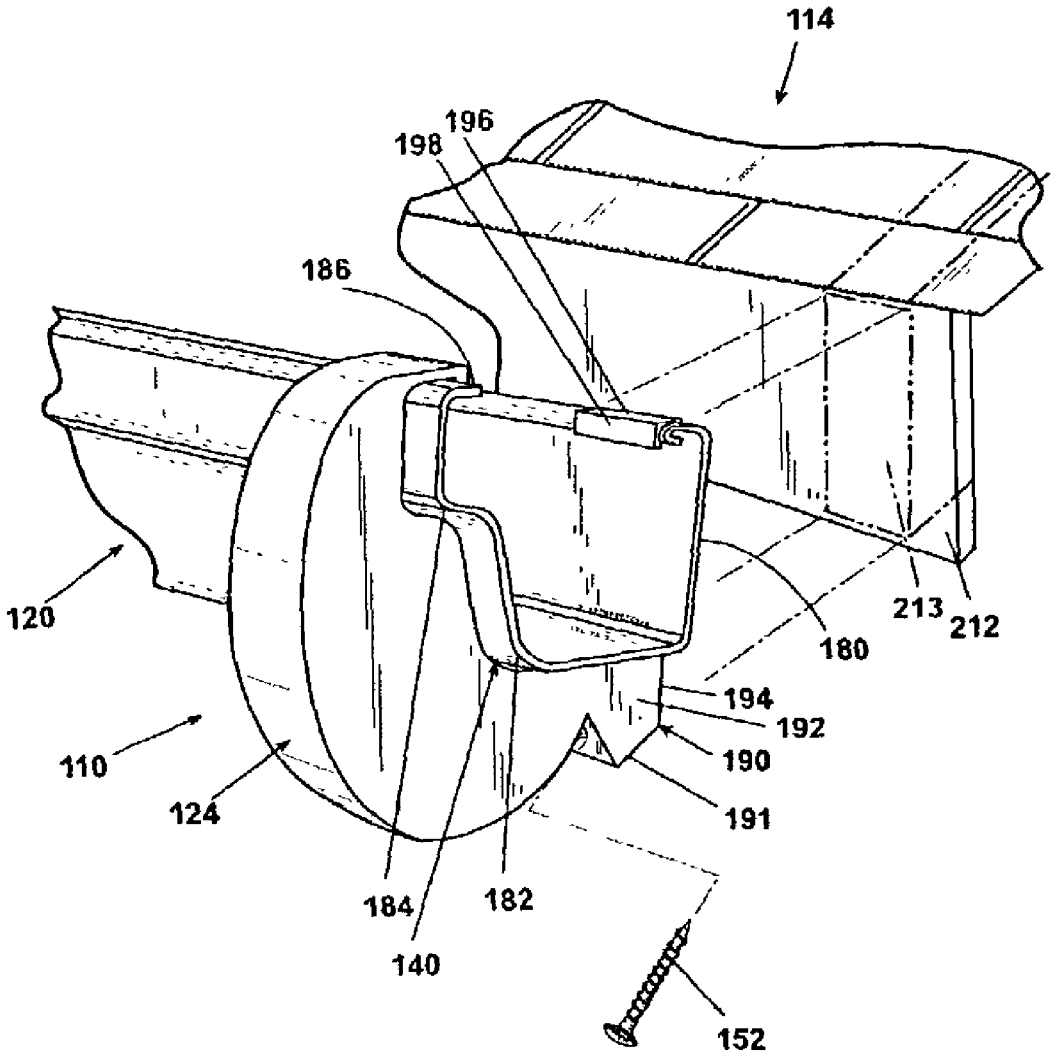
FIG. 18 is a partially exploded view of a portion of a roof, the simulated exposed roof rafter end of FIG. 17, and a conventional rain gutter showing the rain gutter being cradled by the simulated exposed roof rafter end and the attachment of the simulated exposed roof rafter end to a roof fascia board.

The simulated exposed roof rafter end 110 shown in FIG. 16 is also provided with a plurality of mounting apertures 150 penetrating the back leg 202 for receipt of fasteners 152 for mounting of the simulated exposed roof rafter end 110 to a fascia board 212 or roof rafter end 213, as shown in FIG. 18. The simulated exposed roof rafter end 110 shown in FIG. 16 is also provided with a mounting aperture 154 extending through the proximal portion 190 at a lower end thereof for receipt of a fastener 152 for mounting of the simulated exposed roof rafter end 110 to a fascia board or roof rafter end.

With the simulated exposed roof rafter end 110 mounted to a fascia board or roof rafter end, the gutter 120 is inserted into the cradle 200 by inserting the upper end of the rear gutter wall 180 into the rear gutter wall slot 204 and rotating the gutter 120 downwardly and forward to position the gutter front wall 184 against the cradle outer surface 138 to securely lock the gutter 120 into the cradle 200.

Figure 17:
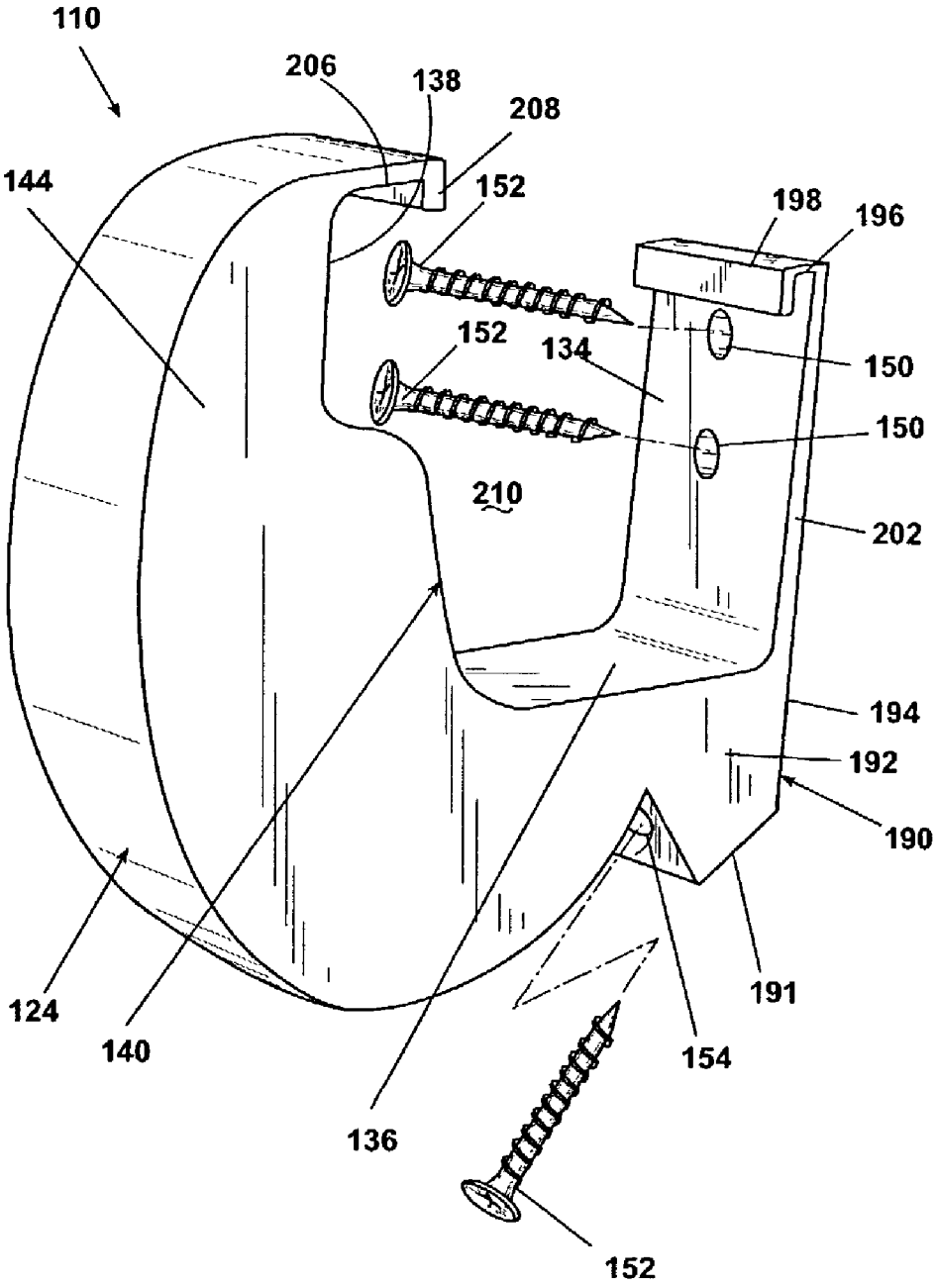
FIG. 17 is a perspective view of an eleventh embodiment of the invention comprising a simulated exposed roof rafter end with integral rain gutter support similar to that shown in FIG. 16 and further comprising a front retaining flange lip.

FIG. 17 shows yet another embodiment of the simulated exposed roof rafter end with integral rain gutter support 110 similar to the embodiment shown in FIG. 16. In this embodiment, the upper part of the distal portion 124 comprises a front retaining flange 106 terminating in a downwardly-extending retaining flange lip 208 orthogonal thereto to define a cradle 210. The retaining flange lip 208 slidably communicates with the gutter top lip 186 to maintain the gutter front wall 184 in communication with the cradle outer surface 138. The rain gutter 120 is slidably received within the cradle 210 so that the upper end of the rear gutter wall 180 is received in the rear gutter wall slot 204 and the gutter top lip 186 is secured by the retaining flange lip 208, as shown in FIG. 18.

Figure 19:
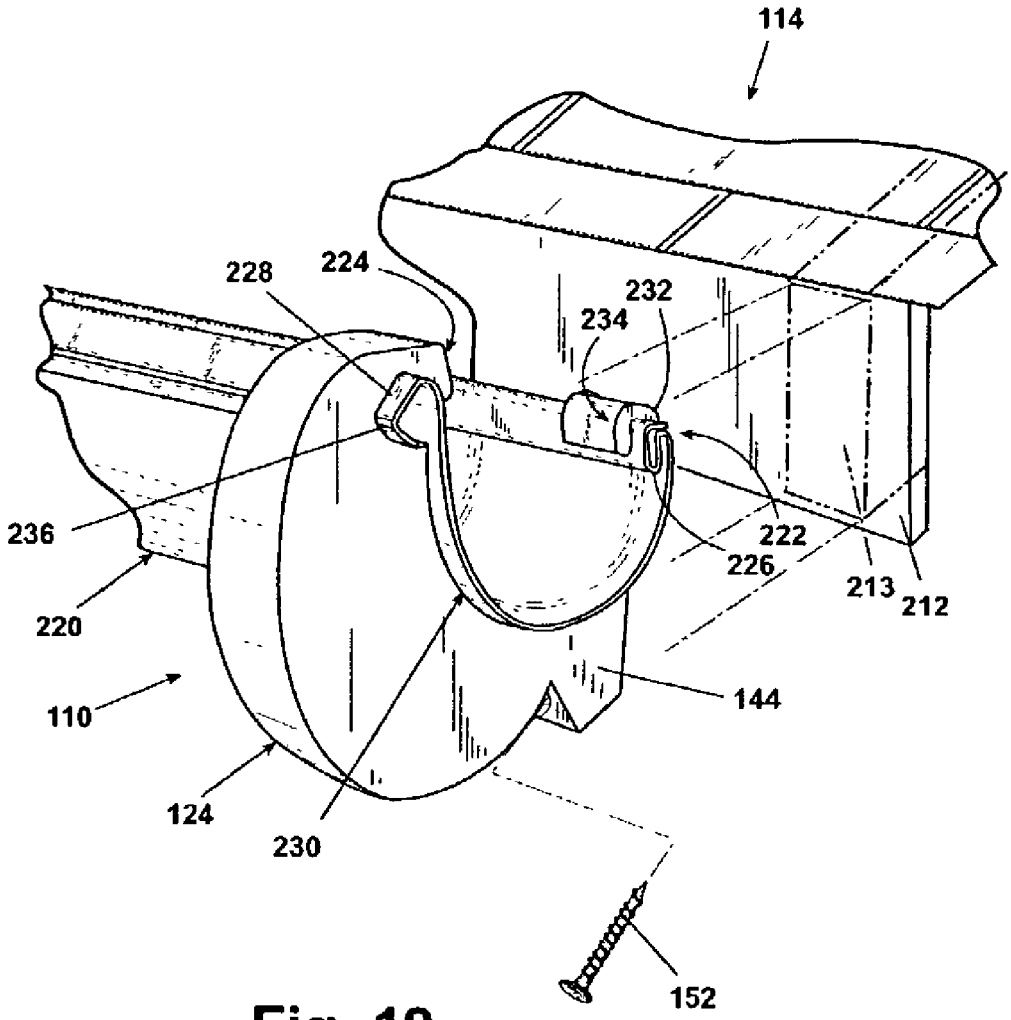
FIG. 19 is a partially exploded view of a portion of a roof, a twelfth embodiment of the invention comprising the simulated exposed roof rafter end with integral rain gutter support, and a flexible rain gutter showing the rain gutter being cradled by the simulated exposed roof rafter end and the attachment of the simulated exposed roof rafter end to a roof fascia board.
Figure 20:
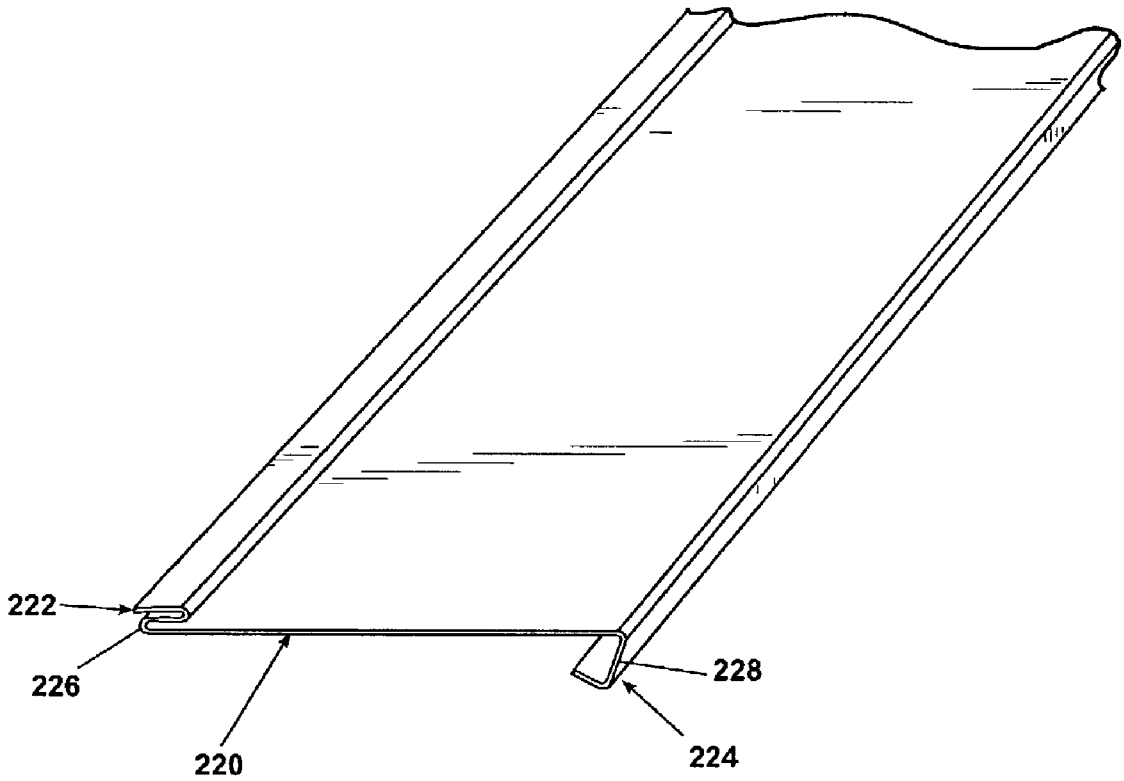
FIG. 20 is a perspective view of a portion of the flexible rain gutter shown in FIG. 19.

FIGS. 19 and 20 show an embodiment of the simulated exposed roof rafter end with integral rain gutter support 110 which is adapted for use with a flexible rain gutter 220. The flexible rain gutter 220 comprises a sheet of flexible gutter material, such as vinyl or aluminum, which can be fabricated in selected lengths corresponding to the associated eave lengths, thereby eliminating joints between multiple gutter sections forming an extended straight run and the resulting leaks that characterize such installations. The flexible gutter 220 can also be fabricated in preselected lengths, e.g. 8 ft., 10 ft., 12 ft., etc. In such a case, the simulated exposed roof rafter ends 110 are mounted so that the seams between abutting gutter sections are located at the centers of the simulated exposed roof rafter ends 110 to provide support to the abutting gutter ends. The simulated exposed roof rafter ends 110 can accommodate a variety of leak-proof connectors, such as thin plastic straps attached to the abutting gutter ends with glue or caulk. The gutter 220 has a proximal edge 222 which lies adjacent the roofline, and an outward-facing distal edge 224. The proximal edge 222 is folded and crimped into a generally flattened edge crimp 226 to reinforce and strengthen the proximal edge 222. The distal edge 224 is folded into an outwardly-directed reinforcing lip 228 having a generally rounded, square, or triangularly-shaped cross section to reinforce and strengthen the distal edge 224. The portion of the gutter 220 intermediate the proximal edge 222 and the distal edge 224 is flexible and can be readily bent about a longitudinal axis parallel to the edges 222, 224. The flexibility of the material causes the gutter 220 to tend to maintain its flattened configuration.

The simulated exposed roof rafter end with integral rain gutter support 110 shown in FIG. 19 is similar to that shown in FIGS. 16–18 except for the shape of the gutter cradle 210 and the gutter edge retaining elements 196, 198, 206, 208. The simulated exposed roof rafter end with integral rain gutter support 110 shown in FIG. 19 comprises a generally arcuate cradle 230. The proximal portion of the simulated exposed roof rafter end 110 has an inwardly-extending rear retaining flange 232 terminating in a downwardly-extending rear retaining flange lip 234 similar to the retaining flange 196 and retaining flange lip 198 of FIG. 16 and adapted to slidably receive the edge crimp 226. The upper part of the distal portion 124 comprises a reinforcing lip cradle 236 adapted to slidably receive the reinforcing lip 228.

With the simulated exposed roof rafter end 110 mounted to a fascia board or roof rafter end, the gutter 220 is inserted into the cradle 230 by inserting the proximal edge 222 behind the retaining flange lip 234 and snapping the reinforcing lip 228 into the reinforcing lip cradle 236 to securely lock the gutter 220 into the cradle 230. The flexibility of the gutter 220 facilitates its insertion into the cradle 230. The tendency of the gutter 220 to maintain its flattened configuration, as shown in FIG. 20, contributes to the "locking" of the gutter 220 into the desired shape and position in the simulated exposed roof rafter end 110.

Figure 21:
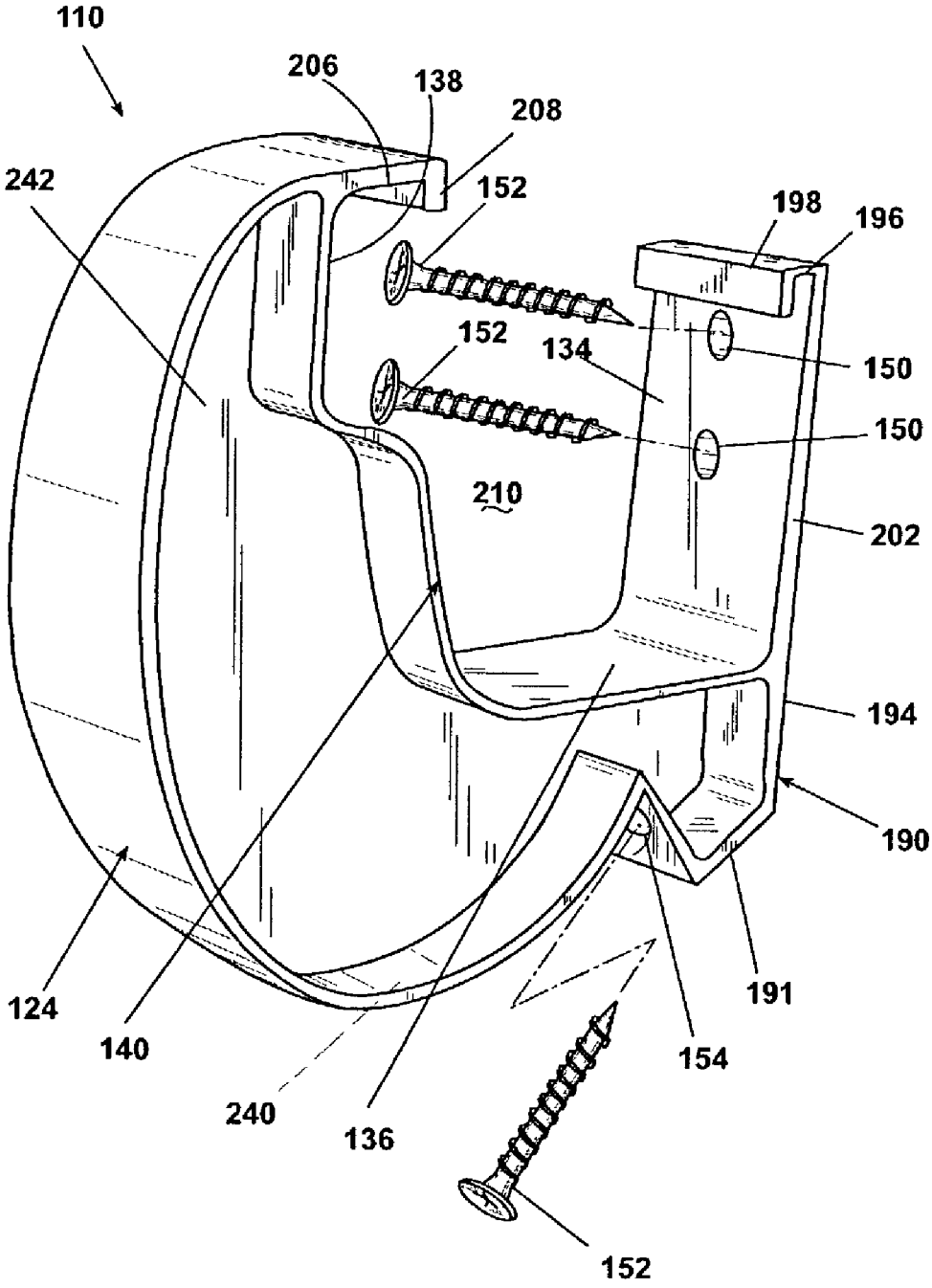
FIG. 21 is a perspective view of a thirteenth embodiment of the invention comprising a simulated exposed roof rafter end with integral rain gutter support similar to that shown in FIG. 17 and further comprising a peripheral flange and center web.

FIG. 21 shows a thirteenth embodiment of the simulated exposed roof rafter end with integral rain gutter support 110 which is similar to the embodiments shown in FIGS. 11–19 but in which the side walls 144 have been replaced with a generally planar center web 242 terminating in a peripheral flange 240 extending orthogonally from the center web 242 approximately equally on either side of the center web 242 to form a simulated exposed roof rafter end having a generally I-beam shaped cross section. The embodiment shown in FIG. 21 is preferably fabricated through a generally conventional injection molding process. The flange and web structure provides a simulated exposed roof rafter end with integral rain gutter support having sufficient strength but with a savings in material, thereby decreasing weight and cost.

It is anticipated that the simulated exposed roof rafter end with integral rain gutter support 110 will be fabricated of a polymeric material, such as a polyurethane or polyvinyl material, through a conventional manufacturing process, such as extrusion or injection molding. With all embodiments, the simulated exposed roof rafter end with integral rain gutter support 110 can be mounted to a fascia board or roof rafter end corresponding to each joint between abutting gutter section to provide strength and support to the joint. The simulated exposed roof rafter ends 110 can accommodate a variety of leak-proof connectors, such as thin plastic straps attached to the abutting gutter ends with glue or caulk. The spacing of the simulated exposed roof rafter ends 110 to correspond to the gutter section joints gives the appearance of a seamless gutter.

In the embodiments described herein, the simulated exposed roof rafter end with integral rain gutter support 110 has been shown for convenience as comprising a solid member. So that the roof rafter end 110 has sufficient strength for attachment to the fascia board 112, it is preferable for the proximal end 122 to comprise a solid mounting member. However, the proximal end 122 can alternatively comprise a sleeve to be received over a mounting frame or an exposed roof rafter end for mounting the simulated exposed roof rafter end with integral rain gutter support 110 as described generally for the embodiments shown in FIGS. 1–9. Additionally, the distal end 124 can be fabricated as a generally hollow member, which can also be foam filled, in order to save weight and materials.

The simulated exposed roof rafter end 10, 110 provides, in a single, integrated piece, the desirable architectural flourish of an exposed roof rafter end with or without the benefits of a roof rain gutter, which can be readily attached to a building with a minimum of effort and waste material The simulated exposed roof rafter end 10, 110 can have a variety of shapes to reflect differing architectural styles, can comprise any material providing suitable strength and durability, such as a high-strength plastic, and can be colored to coordinate with the color scheme of the structure. Fabrication of the simulated exposed roof rafter end 10, 110 can be closely controlled to ensure a uniformity of appearance that would be difficult to achieve with hand-cutting design shapes and a rain gutter support cradle into wood rafter ends.

While particular embodiments of the invention have been shown, it will be understood that the invention is not limited thereto. Reasonable variation and modification are possible within the scope of the foregoing disclosure and drawings, particularly in light of the foregoing teachings, without departing from the spirit of the invention which is defined in the appended claims.

The invention claimed is:

1. A combination roof eave and simulated exposed roof rafter end for a building:

the roof eave comprising a fascia and a soffit, and the simulated exposed roof rafter end comprising a sleeve portion and a mounting portion, the mounting portion is attached to the building, and the sleeve portion is slidably attached to the mounting portion and comprises a distal end having an architectural design.

2. The combination roof eave and simulated exposed roof rafter end of claim 1 wherein the mounting portion is a frame.

3. The combination roof eave and simulated exposed roof rafter end of claim 1 wherein the mounting portion is a block of wood.

4. The combination roof eave and simulated exposed roof rafter end of claim 3 wherein the block of wood is a rafter end.

5. The combination roof eave and simulated exposed roof rafter end of claim 1 wherein the sleeve portion comprises a top wall, a bottom wall, and a pair of side walls enclosing the mounting portion.

6. The combination roof eave and simulated exposed roof rafter end of claim 1 wherein the mounting portion is attached to the soffit and the sleeve portion comprises a bottom wall and a pair of side walls enclosing the mounting portion.

7. A combination roof eave and simulated exposed roof rafter end:

the roof eave comprising a fascia and a soffit, and the simulated exposed roof rafter end comprising a sleeve portion and a frame attached to the eave, and the sleeve portion slidably attached to the frame and comprising a distal end having an architectural design.

8. The combination roof eave and simulated exposed roof rafter end of claim 7 wherein the sleeve portion comprises a top wall, a bottom wall, and a pair of spaced-apart side walls for enclosing the frame.

9. The combination roof eave and simulated exposed roof rafter end of claim 7 wherein the frame is attached to the soffit and the sleeve portion comprises a bottom wall and a pair of spaced-apart side walls for enclosing the frame.

* * * * *